US005894855A

United States Patent [19]

Gefell

[11] Patent Number: 5,894,855

[45] Date of Patent: Apr. 20, 1999

[54] UMBRELLA

[76] Inventor: Thomas Gefell, 881 10th Ave., #6A, New York, N.Y. 10019

[21] Appl. No.: 08/969,490

[22] Filed: Nov. 13, 1997

[51] Int. Cl.[6] ..... A45B 19/02

[52] U.S. Cl. ..... 135/20.2; 135/21; 135/33.71

[58] Field of Search ..... 135/20.2, 20.1, 135/21, 33.2, 33.71, 33.7

[56] References Cited

U.S. PATENT DOCUMENTS

| | | | |
|---|---|---|---|
| D. 266,456 | 10/1982 | Skrickler | D3/5 |
| 1,411,560 | 4/1922 | Beaty | 135/20.2 |
| 2,736,329 | 2/1956 | Cornellier | 135/20.2 |
| 3,538,928 | 11/1970 | Price | 135/20.2 |
| 3,683,947 | 8/1972 | Muller | 135/20.2 |
| 3,954,117 | 5/1976 | Wallace | 135/20.2 |
| 5,103,848 | 4/1992 | Parsons | 135/20.2 |
| 5,307,827 | 5/1994 | Haddad et al. | 135/20.1 |

FOREIGN PATENT DOCUMENTS

| | | | |
|---|---|---|---|
| 213047 | 10/1955 | Australia | 135/20.2 |
| 1547629 | 11/1968 | France | 135/20.2 |
| 188872 | 2/1957 | Germany | 135/20.2 |

*Primary Examiner*—Carl D. Friedman
*Assistant Examiner*—Winnie S. Yip
*Attorney, Agent, or Firm*—Salzman & Levy

[57] ABSTRACT

An umbrella features a rigid structural stem for supporting a canopy. The rim of the canopy is inflatable, thus providing a circular shape to the canopy periphery. The canopy is made of a flexible material, such as cloth, plastic, canvass or combinations thereof. The plastic material can be transparent or diaphanous. Radially extending rods, that are substantially equally spaced about the canopy, project from the stem towards the inflatable rim to provide further structural support for the canopy. The radial rods do not extend past the rim, thus providing safety. There are three embodiments of the umbrella of this invention. The first embodiment features an umbrella design having a standard curvilinear canopy with inflatable rim. The second embodiment is a conically shaped canopy with inflatable rim. The third embodiment of this invention is a canopy having an upper conically shaped portion surrounded by an inflatable rim. A skirt is attached to the upper portion. The skirt has an inflatable rim about its periphery. The second and third embodiments are substantially different from prior umbrellas in that they have no joints, or movable parts, save the inflatable rims and the flexible material of the umbrella itself. The radially extended rods are not connected to the stem at the apex and they are not connected to the rim of the umbrella.

6 Claims, 2 Drawing Sheets

UMBRELLA

FIELD OF THE INVENTION

The present invention relates to umbrellas and, more particularly, to a plurality of unique umbrella designs featuring an inflatable rim for maintaining structural support for the canopy.

BACKGROUND OF THE INVENTION

The use of umbrellas for protection against sun, rain, hail, snow and other forms of precipitation has its roots in antiquity. The umbrella arts are filled with myriad designs, including fold-up models and inflatables.

One of the major problems with umbrellas of all types is their lack of structural integrity in windy situations. It is a common experience for an umbrella to reverse its canopy, or turn inside out, during strong, turbulent or even moderate wind. Turning an umbrella inside out can result in severe and permanent structural damage, such damage often being the consequence of the twisting and bending of the radial ribs beyond their structural limits.

The present invention seeks to provide a new type of umbrella of the inflatable type, which provides structural integrity during moderate wind, and which does not sustain structural damage during severe or turbulent wind conditions.

The current invention also endeavors to provide new inflatable umbrellas that do not have rigid projections beyond the rim, which projections can easily poke someone in the eye, or be the cause of breakage. The umbrella designs of this invention have rigid ribs in the canopy for structural support that do not extend past the rim of the canopy, and thus are safer and longer-lasting to use. In addition, two of the invention designs contain no rigid joints whatsoever.

DISCUSSION OF RELATED ART

In U.S. Pat. No. Des. 266,456, issued on Oct. 12, 1982, an umbrella design is illustrated which features an umbrella, the rim and main support stem of which are both inflatable. This umbrella has an inflatable rim similar to the current invention, but that is where the similarity ends. This umbrella has no rigid ribs for structural support, and thus cannot be used in windy situations. Even a slight wind will tend to reverse the canopy of this umbrella.

By contrast, the present invention has a rigid structural stem, and rigid radial struts in the canopy, such that it can withstand moderate wind conditions without reversing its canopy. Although the current invention may not endure or tolerate high wind influences, it will nonetheless maintain its structural integrity. That is, even if the canopy reverses, it will not sustain any structural damage. In other words, the umbrella of this invention can be righted after reversal of its canopy so that it may be used again.

SUMMARY OF THE INVENTION

In accordance with the present invention, there is provided a new, inflatable umbrella. The umbrella features a rigid structural stem for supporting a canopy. The rim of the canopy is inflatable, thus providing a circular shape to the canopy periphery. The canopy comprises flexible material, such as cloth, plastic, canvass, or combinations thereof. The plastic material can be transparent or diaphanous. Radially extending rods, substantially equally spaced about the canopy, project from the stem towards the inflatable rim to provide further structural support for the canopy. The radial rods do not extend past the rim, thus providing safety.

Conventional umbrella skeletons have weaknesses at their joints that are eliminated in three designs primarily through the use of an inflatable rim to replace the structural function of the ribs, joints, and locking device; namely, the means of maintaining the shape of the umbrella and the means of locomotion in extending the umbrella. The embodiments each have a uniform circular inflatable rim. This eliminates the safety concerns of having ribs extending past the canopy. It further eliminates the cause of damage associated with said extending ribs catching on various objects.

In one of the embodiments, the current mechanisms for extending the umbrella and maintaining its extension are modified to include the design principle above. That is, this design has the stem-riser-lock-rib-flexor arm design of most current umbrellas. The ribs simply do not extend past the edge of the canopy. The rim of the canopy is maintained by a uniform circular inflatable tube.

In the other two embodiments, the inflatable rim does replace the locomotive function of the flexor arms and the function of the lock on the stem which maintains extension. These designs are radically different from the conventional design in the number of moving parts, the attachments of moving parts, and the means of locomotion. In these new embodiments, the only moving parts are the inflatable rim(s) and the canopy. The ribs are embedded within or attached to the canopy and move passively only as the canopy moves. This is different from conventional devices whence the ribs move actively and are the means of extending the canopy. The invention allows for the canopy to be extended by the inflatable rim; in turn, the canopy moves the ribs. Further, the ribs are not rigidly connected to the stem nor to the rim. The result is that there are no rigid joints which are the primary points of breakage in conventional devices.

There are three embodiments of the umbrella of this invention. The first embodiment (round umbrella) features an umbrella design having a standard curvilinear canopy with inflatable rim. The second embodiment (jointless umbrella) is a conically-shaped canopy with inflatable rim. The third embodiment of this invention (jointless umbrella with skirt(s)) is a canopy having an upper conically shaped portion surrounded by an inflatable rim. A skirt is attached to the upper portion. The skirt extension comprises an inflatable rim about its periphery.

In the round umbrella embodiment, the rim is inflatable and round. This has three general benefits over the prior art: 1) Safety—no ribs extending beyond the rim reduce the risk of injury; 2) Structural integrity—no ribs extending beyond the rim eliminate the likelihood of the rib end catching on something and breaking; and 3) Structural strength—the inflated rim provides strength.

The set of ribs and flexor arms of the present invention provides structural support for maintaining a uniform extended position. The riser, in addition to the ribs and flexor arms, provides the means of actuating the umbrella into the extended position.

In the jointless umbrella embodiment, the rim is also inflatable and round. The three benefits of this design are also listed above. The inflation of the rim is the means of actuating the umbrella into the extended position. The inflated rim, together with a set of rigid ribs, form the structural support for maintaining a uniform extended position. The ribs are rigid, static, and uniformly placed about the umbrella, and not rigidly connected to the stem nor the rim. They are embedded within or attached to the material of the canopy. There are no flexor arms, nor rigid joints.

In the jointless umbrella with skirt(s) embodiment, the uppermost section is identical to the jointless umbrella described above. Below the code of the uppermost section is passively suspended a skirt or series of skirts of like design comprised of an exterior (lower) inflatable rim and rigid ribs embedded within or attached to the canopy extending radially and located uniformly about the umbrella.

The rims of all of the embodiments are inflatable and round. The inflation of the rims are the means of actuating the umbrella into the extended position. The inflated rims, together with sets of rigid ribs, form the structural support for maintaining a uniform extended position. The ribs are rigid, static, and uniformly placed about the umbrella. The ribs are not rigidly connected to the stem nor any of the rims. They are embedded within or attached to the material of the canopy, eliminating the need for flexor arms and rigid joints.

It is an object of this invention to provide an improved umbrella.

It is another object of the invention to provide an inflatable umbrella that functions in moderate wind.

It is another object of the invention to provided an umbrella not subject to the inherent weakness of rigid joints.

It is another object of the invention to provide an umbrella not subject to an irregular rim (i.e., protruding ribs).

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like components and elements will bear the same numbering and designation throughout the figures.

DESCRIPTION OF THE PREFERRED EMBODIMENT

Generally speaking, the invention features an inflatable-type umbrella having superior characteristics in wind conditions. The umbrella comprises an inflatable rim, which provides structural strength and rigidity to the canopy portion. Reinforcing rods extend radially from the support stem to the rim portion, but do not project past the rim, thus providing a safer umbrella design.

Figure 1:
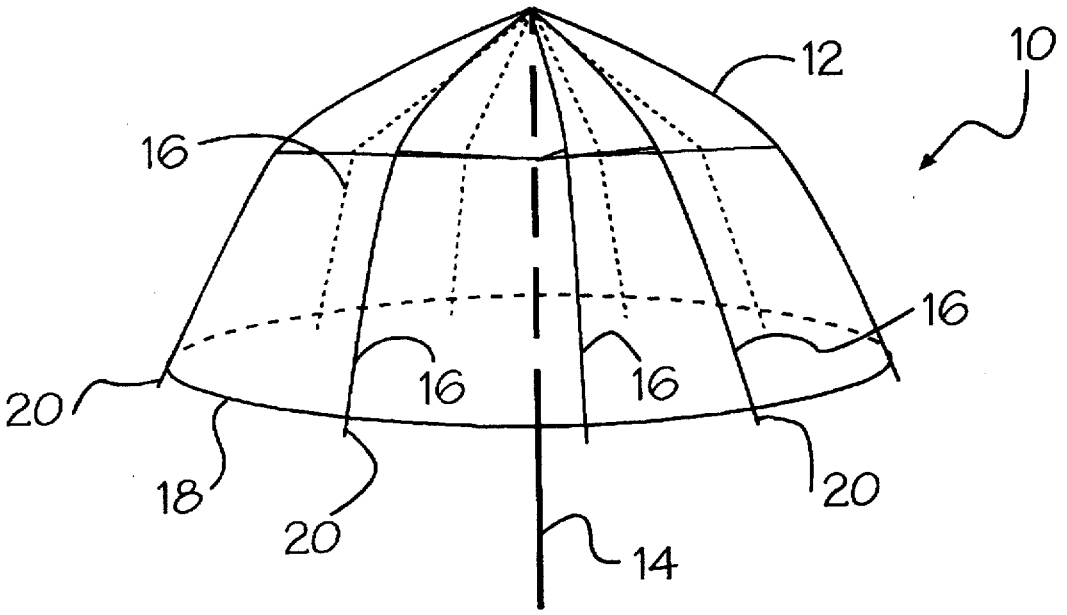
Figure 1 (Prior Art)
FIG. 1 illustrates a schematic, perspective view of a prior art umbrella.

Now referring to FIG. 1, a prior art umbrella 10 is shown. The prior art umbrella 10 is of a standard design, and features a curvilinear or dome shaped canopy 12, a rigid stem 14 for supporting the canopy 12, and reinforcement ribs 16 that are evenly spaced about the canopy 12, and that extend from the stem 14 past the circular periphery 18 of the canopy 12. The projecting tips 20 of each reinforcement rib 16 is a potential hazard, since they can easily jab themselves into an eye of the user or an adjacent person. They also represent a structural flaw, since they can easily catch on an object and bend or break the rib.

Figure 2:
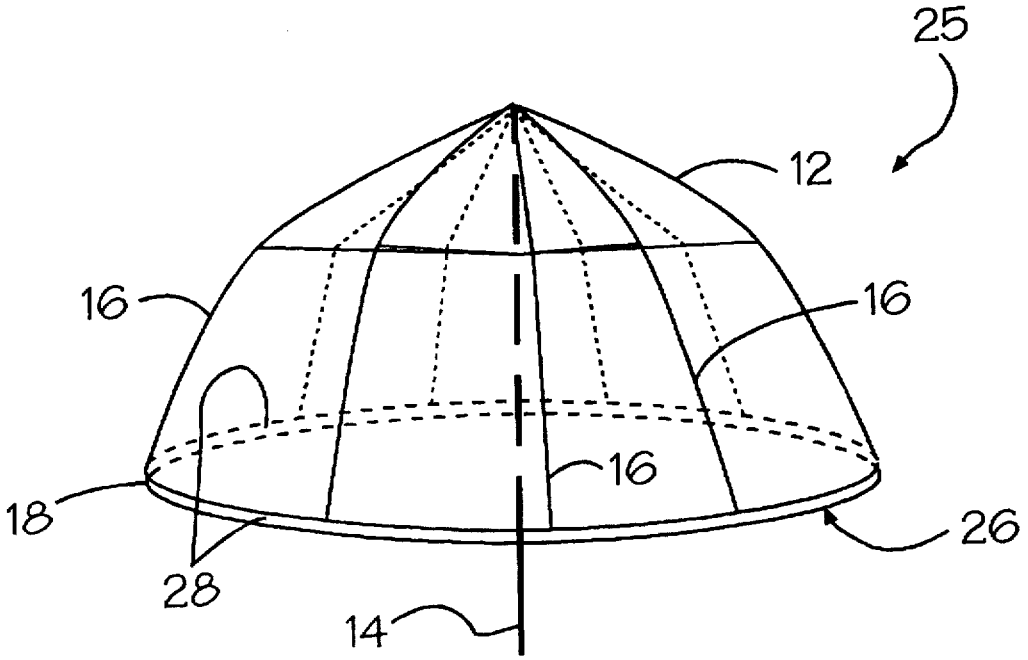
FIG. 2 depicts a schematic, perspective view of a first embodiment of this invention.

Now referring to FIG. 2, a first embodiment of the umbrella of this invention is illustrated. The umbrella 25 of this embodiment comprises a curvilinear canopy 12 and a rigid support stem 14, similar to that of the prior art umbrella 10 (FIG. 1). The umbrella 25 has reinforcing ribs 16 substantially evenly spaced about the canopy 12. The reinforcing ribs 16 do not project past the outer periphery 18 of the canopy 12. Rather, the outer periphery 18 contains and supports an inflatable rim 26 comprising a flexible tubular member 28. The reinforcing ribs 16 extend radially from the stem 14 to the inflatable rim 26, the reinforcing ribs 16 are not rigidly connected to the stem 14 nor to the rim 26, the reinforcing ribs 16 suspended by canopy material. The rim 26 is generally left in an uninflated condition prior to umbrella usage, so that the umbrella 25 can be folded easily and stored within a protective sleeve (not shown).

Figure 3:
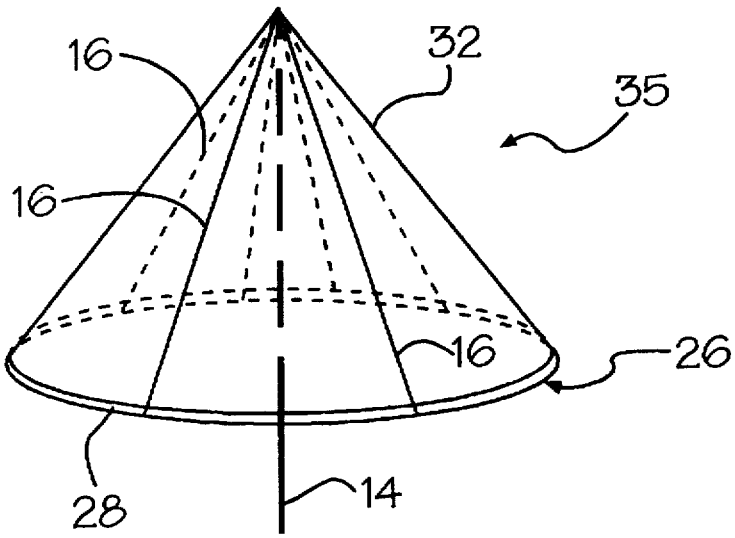
FIG. 3 shows a schematic, perspective view of a second embodiment of the invention.

Referring to FIG. 3, a second embodiment of the umbrella of this invention is illustrated. The umbrella 35 of this embodiment is similar to the first embodiment umbrella 25 in that it contains identical elements and components 14, 16, 26 and 28, respectively. The second embodiment differs from the first embodiment in that the shape of the canopy 32 is substantially conical.

The second embodiment umbrella 35 operates as follows. Inflation of the tubular member 28 causes the canopy 12 to expand and rise above the stem 14, thus preparing the umbrella 25 for use. Expansion of the tubular member 28 provides the structural rigidity to the canopy 12 as a substitute for the reinforcement provided by the extender or flexor arms. The inflatable rim 26 also has the advantage of potentially eliminating the riser needed to actuate the prior art flexor arms into their extended position.

Figure 4:
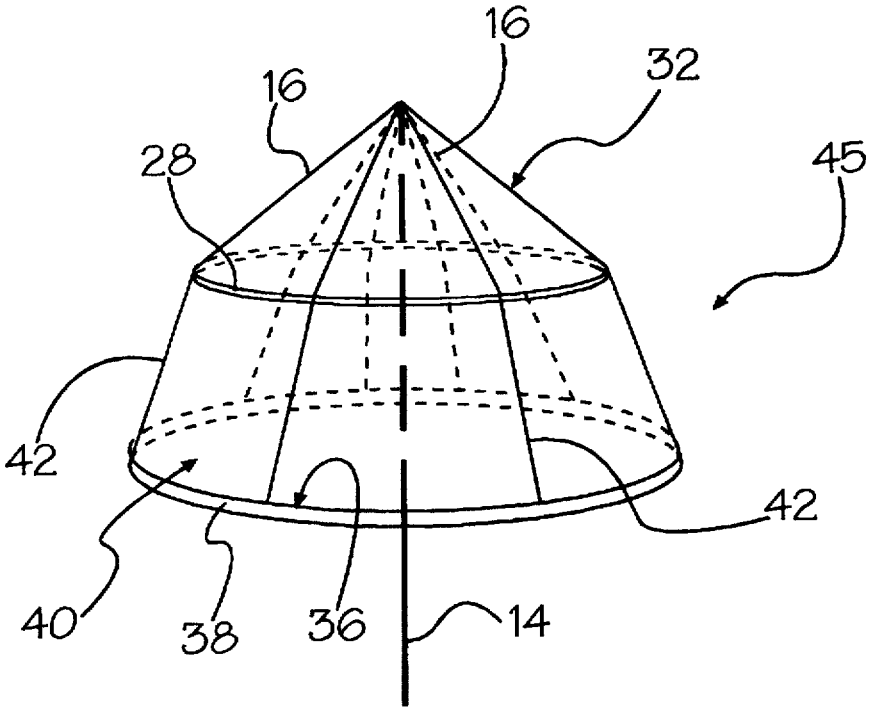
FIG. 4 illustrates a schematic, perspective view of a third embodiment of this invention.

Referring to FIG. 4, a third umbrella embodiment is depicted. The umbrella 45 of this embodiment is similar in design to the umbrella 35 illustrated in FIG. 3. The umbrella 45 is characterized by the addition of a skirt member 40. The skirt member 40 extends from the conical canopy 32 and inflatable tubular member 28, as shown. The skirt member 40 comprises an inflatable tubular member 38 about the periphery 36 thereof. The skirt member 40 can comprise reinforcing ribs 42, as illustrated.

The inflatable tubular members 28 and 38, respectively, can comprise standard plastic inflation stems (not shown), with plastic stoppers for sealing and unsealing the tubular member, as is standard in the art. The tubular member 28 may also be attached to a flexible inflation tube, running radially from the tubular member to the stem of the umbrella, as an inflation mechanism contained thereon.

The canopy can comprise a flexible material, such as cloth, plastic, canvass or combinations thereof. The plastic material can be transparent or diaphanous.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An inflatable type umbrella, comprising:

a substantially rigid support stem;

a canopy carried by said substantially rigid support stem, said canopy having a periphery;

a plurality of reinforcement ribs disposed substantially equally around said canopy for providing structural support to said canopy, said ribs extending from lust before the support stem to lust before said periphery;

a first inflatable rim disposed about said periphery of said canopy to provide structural rigidity to said canopy; and a second inflatable rim extending from said first inflatable rim, said second inflatable rim forming a skirt, said umbrella being characterized by having rigidity provided by both said first and second inflatable rims, and further wherein said umbrella is opened to an extended position by inflation of both of said first and second inflatable rims.

2. The inflatable type umbrella in accordance with claim 1, wherein said skirt further comprises reinforcing ribs.

3. The inflatable type umbrella in accordance with claim 1, wherein said canopy comprises a conical shape.

4. The inflatable type umbrella in accordance with claim 1, wherein said canopy comprises a curvilinear shape.

5. The inflatable type umbrella in accordance with claim 1, wherein said canopy comprises a material selected from a group of flexible materials consisting of: cloth, plastic, canvass and combinations of cloth, plastic or canvass.

6. An inflatable type umbrella, comprising:

a substantially rigid support stem;

a canopy carried by said substantially rigid support stem, said canopy having a periphery;

a plurality of reinforcement ribs disposed substantially equally around said canopy for providing structural support to said canopy, said ribs extending from just before the support stem to just before said periphery;

an upper inflatable rim disposed about said periphery of said canopy to provide structural rigidity to said canopy; and a lower inflatable rim extending from said upper inflatable rim, said lower inflatable rim forming a skirt, said umbrella being characterized by having rigidity provided by both said upper and lower inflatable rims, and further wherein said umbrella is opened to an extended position by inflation of both of said upper and lower inflatable rims.

* * * * *